US008058785B2

(12) United States Patent
Boehler et al.

(10) Patent No.: US 8,058,785 B2
(45) Date of Patent: Nov. 15, 2011

(54) SPARK PLUG STRUCTURE FOR IMPROVED IGNITABILITY

(75) Inventors: Jeffrey T. Boehler, Holland, OH (US); Matthew B. Below, Findlay, OH (US)

(73) Assignee: Fran Group IP LLC

( * ) Notice: Subject to any disclaimer, the term of this patent is extended or adjusted under 35 U.S.C. 154(b) by 372 days.

(21) Appl. No.: 12/234,834

(22) Filed: Sep. 22, 2008

(65) Prior Publication Data

US 2009/0079319 A1 Mar. 26, 2009

Related U.S. Application Data

(60) Provisional application No. 60/974,316, filed on Sep. 21, 2007.

(51) Int. Cl.
*H01T 13/20* (2006.01)

(52) U.S. Cl. ..... 313/143; 313/118; 313/141; 313/142

(58) Field of Classification Search ..... 313/118, 313/141, 142, 143
See application file for complete search history.

(56) References Cited

U.S. PATENT DOCUMENTS

| | | | | |
|---|---|---|---|---|
| 4,082,976 | A | 4/1978 | Lentz | |
| 4,110,667 | A * | 8/1978 | Graf Vom Hagen | 313/143 |
| 4,845,400 | A * | 7/1989 | Takamura et al. | 313/142 |
| 4,949,006 | A | 8/1990 | Oshima et al. | |
| 4,963,784 | A * | 10/1990 | Niessner | 313/131 R |
| 5,124,612 | A * | 6/1992 | Takamura et al. | 313/141 |
| 5,159,232 | A * | 10/1992 | Sato et al. | 313/141 |
| 5,239,225 | A * | 8/1993 | Moriya et al. | 313/141 |
| 5,557,158 | A * | 9/1996 | Kanao et al. | 313/141 |
| 5,734,222 | A | 3/1998 | Callaghan | |
| 6,864,622 | B2 * | 3/2005 | Matsutani et al. | 313/141 |
| 2003/0001474 | A1 * | 1/2003 | Teramura et al. | 313/141 |
| 2003/0038576 | A1 * | 2/2003 | Matsutani et al. | 313/141 |
| 2003/0214210 | A1 * | 11/2003 | Lipp et al. | 313/118 |
| 2005/0052107 | A1 * | 3/2005 | Klett et al. | 313/143 |
| 2005/0168121 | A1 * | 8/2005 | Tinwell | 313/141 |
| 2007/0132354 | A1 * | 6/2007 | Scott et al. | 313/141 |

FOREIGN PATENT DOCUMENTS

| | | | |
|---|---|---|---|
| JP | 63-216282 | A | 9/1988 |
| JP | 06-052965 | A | 2/1994 |
| JP | 2560713 | B2 | 12/1996 |

OTHER PUBLICATIONS

Written Opinion of the International Searching Authority dated Mar. 27, 2009 for PCT/US2008/077188.
International Search Report of the International Searching Authority dated Mar. 27, 2009 for PCT/US2008/077188.

* cited by examiner

*Primary Examiner* — Nimeshkumar Patel
*Assistant Examiner* — Thomas A Hollweg
(74) *Attorney, Agent, or Firm* — Cantor Colburn LLP

(57) ABSTRACT

Exemplary embodiments of the present invention provide a spark plug for use in conjunction with an internal combustion engine, and, more particularly, to a spark plug having a structure providing improved ignition capability. In one particular configuration, a spark plug is provided forming a gap between a center electrode and an insulator of the spark plug. However, it will become apparent that other configurations are contemplated as well, as shown and described herein.

14 Claims, 4 Drawing Sheets

SPARK PLUG STRUCTURE FOR IMPROVED IGNITABILITY

CROSS REFERENCE TO RELATED APPLICATION

This application claims the benefit of the following U.S. Provisional Patent Application Ser. No. 60/974,316, filed Sep. 21, 2007, the contents of which are incorporated herein by reference thereto.

BACKGROUND

This application relates to a spark plug for use in conjunction with an internal combustion engine, and, more particularly, to a spark plug having a structure providing improved ignition capability.

Conventional spark plugs for use in internal combustion engines generally include a tube-shaped metallic shell, an insulator, a center electrode, and a ground electrode. The metal shell has a threaded portion for fitting the spark plug into a combustion chamber of the engine. The insulator has a center bore formed therein and is fixed in the metal shell such that an end of the insulator protrudes from an end of the metal shell. The center electrode is secured in the center bore of the insulator so that an end thereof protrudes from the end of the insulator. The ground electrode has a tip portion and is joined to the end of the metal shell such that the tip portion faces the end of the center electrode through a spark gap therebetween.

In recent years, the demand for internal combustion engines that provide higher power output has led to an increase in the number and/or size of engine intake and exhaust valves in engines, as well as the introduction of water jackets secured to engines to provide for cooling. This has led to a decrease in the amount of space available for spark plug installation in the engine, thereby necessitating the development of spark plugs having a compact structure. More specifically, narrow spark plugs in which the threaded portion of the metal shell has an outer diameter of 12 mm or less are now being standardized. In practice, compact spark plugs with a shell outer diameter of 12 mm or less result in a reduced distance between the metal shell and the center electrode of the insulator. Thus, the volume of the air pocket is accordingly reduced.

During operation of compact spark plugs having a reduced air pocket volume, there is an increased tendency for the spark, rather than forming and remaining at the electrode gap as intended, to creep sideways from the center electrode along the outer surface of the insulator and jump across the air pocket to the metal shell. This phenomena, known as an inside spark or a side fire, can cause a misfire or a partial burning that reduces engine efficiency. Moreover, certain spark plugs, in particular those having a shell thread size of 12 mm or less along with a shell thread reach of 19 mm or more, tend to possess the additional drawback of having a lower resistance to over-torquing forces that can cause the seal between the metal shell and the insulator to loosen from extension.

Accordingly, it is desirable to provide an improved spark plug structure that prevents the inside spark/side fire phenomena and results in a seal that is more resistant to over-torquing forces.

SUMMARY

Exemplary embodiments of the present invention relate to a spark plug comprising a tubular metallic shell, an insulator, and a generally cylindrical center electrode assembly. The metallic shell has a shell bore extending axially therethrough and a first open end proximate a spark gap. The insulator is at least partially disposed within the shell bore. The insulator has an insulator bore extending axially therethrough and a first open end proximate the spark gap. The insulator has an intermediate portion adjoining an end portion. The end portion has a nose portion axially extending beyond the first open end of the metallic shell by a first length to the first open end of the insulator. The center electrode assembly is at least partially disposed within the insulator bore and has a first end forming part of the spark gap. The center electrode assembly axially extends beyond the first open end of the metallic shell by at least the first length. The end portion of the insulator has an inner diameter that is greater than an outer diameter of an axially corresponding section of the center electrode assembly to form an insulation gap within the insulator bore. The insulation gap axially extends between the center electrode assembly and the end portion of the insulator to the first open end of the insulator.

DESCRIPTION OF EXEMPLARY EMBODIMENTS

Figure 1:
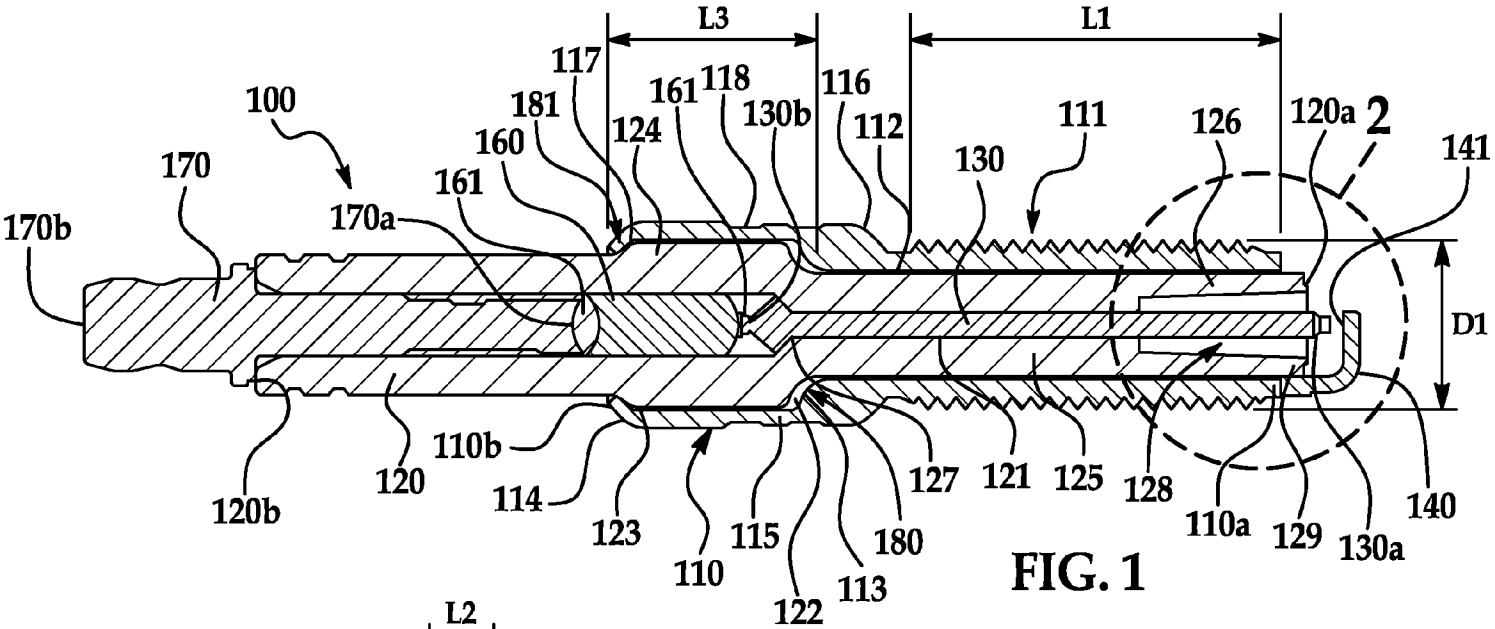
FIG. 1 is a cross-sectional view of an exemplary embodiment of a spark plug in accordance with the present invention.
Figure 2:
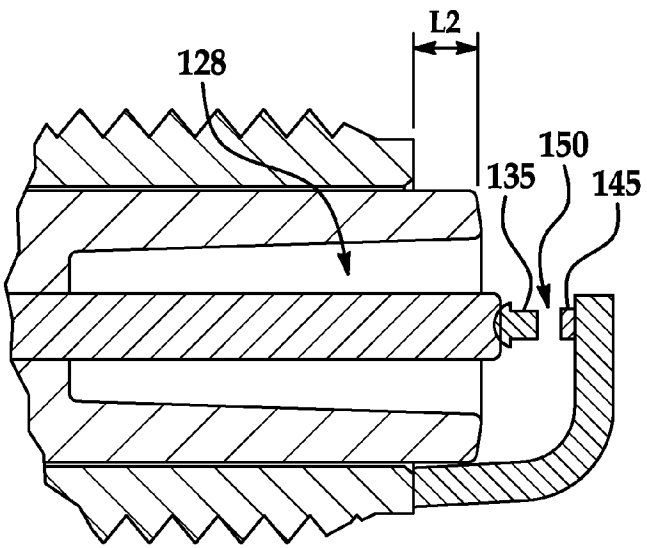
FIG. 2 is an enlarged view of the circumscribed area labeled 2 in the exemplary embodiment of FIG. 1.

FIGS. 1 and 2 illustrate an overall structure of a spark plug 100 according to an exemplary embodiment of the present invention. Spark plug 100 is designed for use in internal combustion engines of automotive vehicles. The installation of spark plug 100 into an internal combustion engine is achieved by fitting it so that it protrudes into a combustion chamber (not shown) of the engine through a threaded bore provided in the engine head (not shown).

As shown in FIG. 1, the spark plug 100 essentially includes an essentially tube-shaped metal shell 110, an insulator 120, a cylindrical center electrode 130, and a ground electrode 140 attached to metal shell 110 at its combustion chamber side end.

In the present exemplary embodiment, metal shell 110 comprises a conductive metal material such as, for example, steel. Metal shell 110 has a threaded shank portion 111 on the outer periphery thereof for fitting spark plug 100 into the combustion chamber of the engine in the axial direction, as described above. Metal shell 110 includes an axial bore 112 that extends throughout its length. In exemplary embodiments, threaded potion 111 of metal shell 110 can have an outer thread diameter D1 of 14 mm or less and an axial shell thread reach L1 of 12 mm or more.

Insulator 120 is an elongated component that is partially situated within axial bore 112 and comprises a non-conducting ceramic material such as, for example, alumina ceramic in exemplary embodiments so that it may fixedly retain center electrode 130 while preventing an electrical short between the center electrode and grounded metal shell 110. Insulator 120 is fixed and partially contained in metal shell 110 such that an end 120*a* of the insulator protrudes from an end 110*a* of the metal shell while the opposing end 120*b* of the insulator protrudes from the opposing end 110*b* of the metal shell. Insulator 120 generally includes an axial bore 121 extending therethrough in which center electrode 130 is retained, as well as exterior shoulders 122, 123 that are located at either end of an expanded flange portion 124 of the insulator.

In exemplary embodiments, center electrode 130 can comprise a highly heat conductive metal material such as, for example, Cu, as the core material and a highly heat-resistant, corrosion-resistant metal material such as, for example, a solid nickel alloy, Inconel, another nickel-based alloy, or other suitable metal or metal alloy, as the clad material. In other exemplary embodiments, center electrode can be wholly comprised of a nickel based alloy without having separate core and clad components. Center electrode 130 is secured in center bore 121 of insulator 120 to be electrically isolated from metal shell 110. Center electrode 130 is partially included in metal shell 110 together with insulator 120 such that an end 130*a* of the center electrode is substantially aligned with end 120*a* of the insulator such that the center electrode protrudes only slightly beyond the insulator.

Ground electrode 140, which comprises a nickel-based alloy consisting mainly of nickel in the present exemplary embodiment, is provided as a curvilinear, approximately L-shaped prism, and cooperates with center electrode 130. Ground electrode 140 is joined (for example, by welding) to end 110*a* of metal shell 110. Ground electrode 140 has a tip portion including a side surface 141 that faces end 130*a* of center electrode 130 through a spark gap 150.

The particular design of metal shell 110 may vary in exemplary embodiments. In the present exemplary embodiment, as shown in FIG. 1, metal shell 110 includes threaded portion 111, a substantially frusto-conical interior shoulder 113, and an essentially cylindrical attachment or mounting feature 115 extending between a pair of deformable rims 114, 116 on an exterior of the metal shell. As mentioned above, threaded portion 111 is used to install spark plug 100 into a threaded hole in the cylinder head of an engine. Installation feature 115 can be shaped, for example, in the form of a double hexagon having a shrinking area 118 to permit an appropriate tool, such as a wrench, to engage metal shell 110 for installation or removal of spark plug 100 in the cylinder head. In the transition area between threaded portion 111 and installation feature 115, conical rim 116 serves as an external motor seat for ensuring tightness of the combustion chamber in this area.

Interior shoulder 113 is formed as an annular ledge or rim located on the interior surface of metal shell 110 facing axial bore 112 in the section where the interior diameter of the bore increases. Interior shoulder 113 engages complimentary sized exterior shoulder 122 of insulator 120 via a gas-tight annular seal 180 such that the insulator is prevented from axially moving downwards within metal shell 110. Rim 114 is provided at end 110*b* of metal shell 110 with interior shoulder 117 to mechanically lock metal shell 110 onto complimentary sized second exterior shoulder 123 of insulator 120 such that the insulator is prevented from axially moving upwards within the metal shell. In exemplary embodiments, metal shell 110 can also be joined to second exterior shoulder 123 via a gas-tight annular seal 181. In exemplary embodiments, annular seal 180 and, if present, annular seal 181 can be metal ring gaskets of a type generally used in spark plug constructions and comprised of, for example, steel or iron.

In the present exemplary embodiment, insulator 120 is provided with flange portion 124 located between exterior shoulders 122, 123. The outer diameter of flange portion 124 is largest in insulator 120 to fit in axial bore 112 at mounting feature 115. Insulator 120 also has an intermediate portion 125 that is located within metal shell 110 adjoining flange portion 124 at exterior shoulder 122. Intermediate portion 125 has an outer diameter that is less than that of flange portion 124. As shown in FIG. 1, exterior shoulder 122 has an outer surface that tapers from flange portion 124 to intermediate portion 125. Insulator 120 further has an end portion 126 that includes end 120*a* of insulator 120.

The structure of insulator 120 is configured to provide spark plug 100 with high insulation properties and a high ignition capability. As shown in circled section 2 in FIG. 1, and in the enlarged illustration of circled section 2 provided in FIG. 2, end portion 126 has an inner or annular diameter that is greater than that of intermediate portion 125 and that increases axially from the intermediate portion to end 120*a*. That is, intermediate portion 125 and end portion 126 of insulator 120 have a uniform outer diameter along their length, and end portion 126 has a reduced wall thickness to provide an insulating air pocket or counterbore 128 within center bore 121 that expands towards the firing end. End portion 126 extends out from metal shell 110 and protrudes beyond end 110*a* by a distance L2, as depicted in FIG. 2. In exemplary embodiments, specific dimensions pertaining to the length, the width, and the increase of the inner diameter of end portion 126 will depend largely upon the specific application for which the spark plug is being used.

As described above, the increased inner diameter of end portion 126 is provided to create counterbore 128 within center bore 121 between the end portion and center electrode 130. The relatively large air clearance formed in spark plug 100 around center electrode 130 by counterbore 128 has a range in the lengthwise direction from end 120*a* of insulator 120 to the point where the insulator transitions from end portion 126 to the expanded wall of intermediate portion 125. Thus, in the present exemplary embodiment, counterbore 128 extends beyond end 110*a* of metal shell 110.

Thus, the present exemplary embodiment is configured so that counterbore 128 is located within in center bore 121 between insulator 120 and central electrode 130, rather than within axial bore 112 between the insulator 120 and metal shell 110. Such a configuration permits counterbore 128 to extend in axial alignment with end portion 126 beyond end 110*a* of metal shell 110 to a point in close proximity to end 130*a* of center electrode 130.

In the present exemplary embodiment, counterbore 128, best viewed in FIG. 2, serves to control the heat range of spark plug 100. The protrusion of insulator end portion 126 beyond end 110*a* of metal shell 110, represented by the axial length L2 in FIG. 2, serves to block the tendency for side sparks or inside fire to jump sideways from firing end 130*a* of center electrode 130 to the metal shell. That is, by extending counterbore 128 in axial alignment with end portion 126 of insulator 130 substantially to firing end 130*a* of center electrode 130, in such close proximity to the center electrode, spark plug 100 can significantly decrease the potential for inside fire or side sparks, as sparks having a tendency to creep sideways from the center electrode will enter the relatively large air clearance of the insulating counterbore formed around the center electrode, as is desired, rather than creeping along the outer surface of insulator 120. In exemplary embodiments, length L2 of the protrusion can be 0.5 mm or greater.

To accommodate the formation of counterbore 128 within center bore 121 in manner so that the counterbore extends to a point beyond end 110*a* of metal shell 110 as described, internal annular seal 180 between interior shoulder 113 of the metal shell and exterior shoulder 122 of insulator 120 is located at a point along spark plug 100 above conical rim 116. This result is a shortened axial length L3 between exterior shoulder 123 of insulator 120 at the top end of attachment feature 115 and internal annular seal 180. Beneficially, the shortening of length L3 from the top of metal shell 110 to internal annular seal 180 in this manner allows the internal annular seal between the insulator 120 and metal shell 110 to be more resistant to loosening in response to the application of excessive torque during installation. That is, the resultant reduced length L3 between the seal contact points results in annular seals 180 being more robust to excessive torque during installation spark plug 100 into an engine and resistant to thermal expansion.

Figure 6:
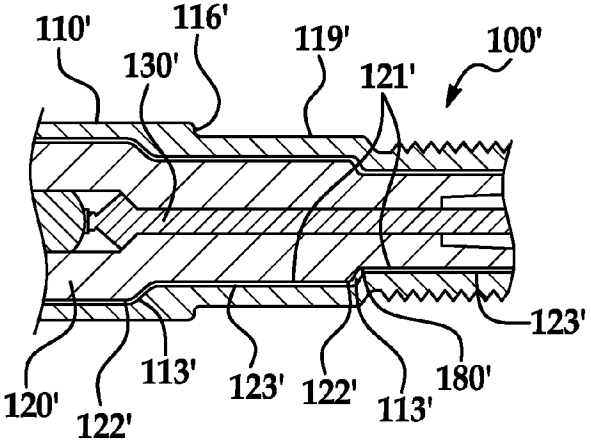
FIG. 6 is an enlarge cross-sectional view of an alternative exemplary embodiment of a spark plug in accordance of the present invention.

Referring to FIG. 6, an alternate spark plug 100' configuration is provided. The spark plug 100' includes an insulator 120' for providing insulation between a center electrode 130' and a metal shell 110'. In this configuration, the insulator 120' includes a plurality steps 121' formed by exterior shoulders 122'. The metal shell 110' also includes a plurality of steps 123' and interior shoulders 113' located adjacent the exterior shoulders 122'. As with the previous embodiment, an annular seal 180', such as a gasket, is provided between one or more of the interior shoulders 113' and exterior shoulders 122' for sealing the spark plug 100'.

Figure 3:
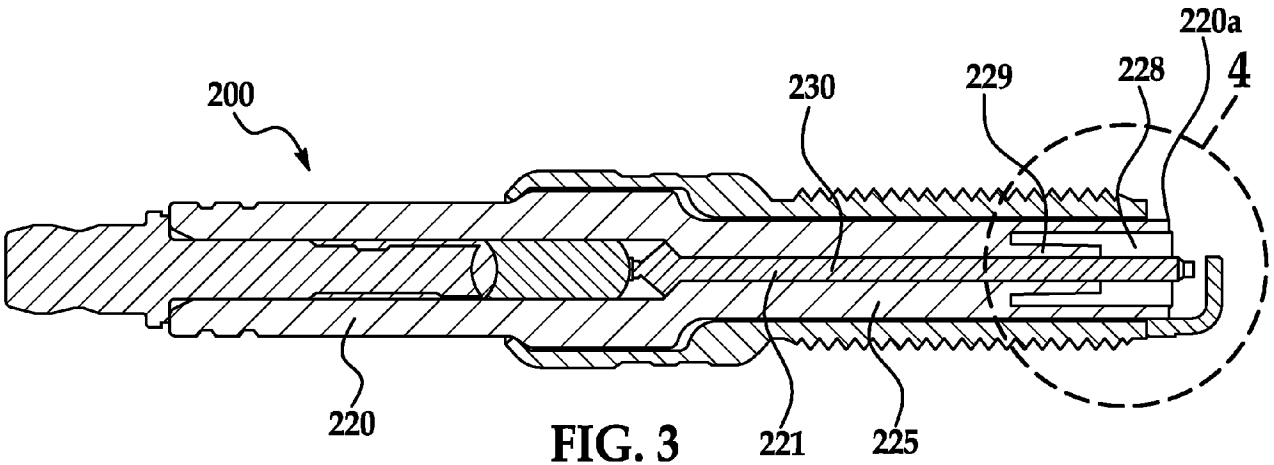
FIG. 3 is a cross-sectional view of an alternative exemplary embodiment of a spark plug in accordance with the present invention.
Figure 4:
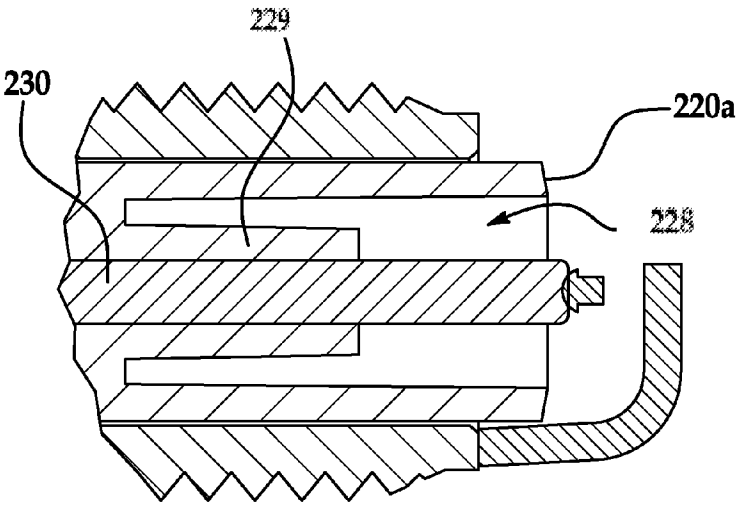
FIG. 4 is an enlarged view of the circumscribed area labeled B in the exemplary embodiment of FIG. 3.

In exemplary embodiments, counterbore 128 can be varied in size and shape to affect spark plug heat range as desired. In accordance with a non-limiting alternative exemplary embodiment, FIGS. 3 and 4 illustrate a spark plug 200 that differs from spark plug 100 of the exemplary embodiment of FIGS. 1 and 2 in that counterbore 228 of is of a different size and shape than counterbore 128. Counterbore 228 is best viewed in FIG. 4, which provides an enlarged illustration of the circled section B in FIG. 3. In this alternative exemplary embodiment, insulator 220 includes an interior annular projection 229 axially extending within axial bore 221 adjacent to center electrode 230 from intermediate portion 225 toward end 220*a* of the insulator.

Figure 7:
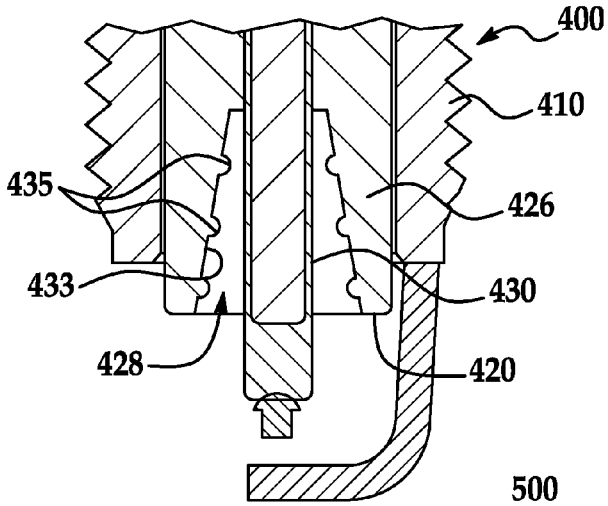
FIGS. 7 through 9 are enlarge cross-sectional views of alternative end portions of an insulator according to an exemplary embodiment of the present invention.
Figure 8:
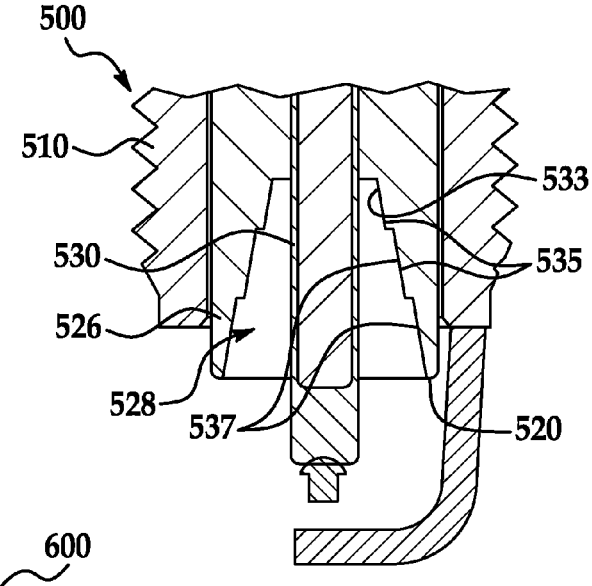
Figure 9:
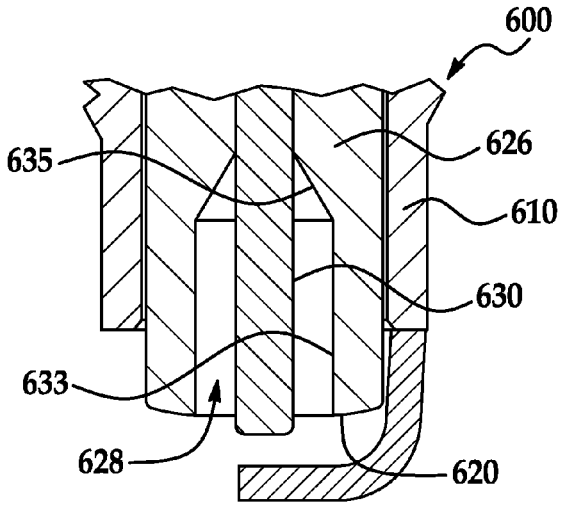

Referring to FIGS. 7 through 9, alternate configurations of insulator end portions are provided. These configurations have several advantageous in that they improve heat distribution through the spark plug by providing different shape configurations of the end portion of the insulator, particularly the counterbore. They also provide improved resistance to inside spark, side fire or the like, by increasing the distance between a center electrode and metal shell. For example, with reference to FIG. 7, a spark plug 400 is provided showing an end portion 426 of an insulator 420, the insulator providing insulation between the center electrode 430 and the metal casing 410. The insulator 420 includes a counter bore 428 forming an interior wall 433. In this configuration, located along the interior wall 433 is one or more, or even a plurality, of projections, such as ribs 435.

With reference to FIG. 8, another spark plug 500 is providing showing an end portion 526 of an insulator 520, the insulator providing insulation between the center electrode 530 and the metal casing 510. The insulator 520 includes a counter bore 528 forming an interior wall 533. In this configuration, located along the interior wall 533 are one or more stepped portions 535 forming a plurality of steps 537.

With reference to FIG. 9, another spark plug 600 is providing showing an end portion 626 of an insulator 620, the insulator providing insulation between the center electrode 630 and the metal casing 610. The insulator 620 includes a counter bore 628 forming a first interior wall 633 and a second interior wall 635, wherein the first and second wall extend in a direction non-parallel to one another.

Referring back to the exemplary embodiment of FIG. 2, spark plug 100 is further provided with a first noble metal chip 135 and a second noble metal chip 145, both of which have a cylindrical shape. First noble metal chip 135 and second noble metal chip 145 are spaced from each other so as to form spark gap 150 therebetween. Spark gap 150 is an axial spark gap, meaning that the spark moves primarily in the axial direction as it jumps between the sparking surfaces. As described above, the forming of counterbore 128 in the present exemplary embodiments serves to affect the spark plug heat range to prevent the tendency for side sparks or inside fire.

First noble metal chip 135, which serves as a sparking member of spark plug 100, is joined to end 130*a* of center electrode 130 by laser welding in the present exemplary embodiment. First noble metal chip 135 is not too thin so as to be easily worn down. In exemplary embodiments, first noble metal chip 135 can comprise a platinum-based alloy including platinum in an amount of greater than 50 weight percent and at least one additive, which, in exemplary embodiments, can be selected from iridium, rhodium, nickel, tungsten, palladium, ruthenium, rhenium, aluminum, alumina, and yttrium. In exemplary embodiments, first noble metal chip 135 can comprise an iridium-based alloy including iridium in an amount of greater than 50 weight percent and at least one additive, which, in exemplary embodiments, can be selected from platinum, rhodium, nickel, tungsten, palladium, ruthenium, rhenium, aluminum, alumina, and yttrium. In exemplary embodiments, the platinum- or iridium-based alloy can have a melting point of greater than 1500 degrees Celsius.

Second noble metal chip 145, which also serves as a sparking member of spark plug 100, is joined to side surface 141 of ground electrode 140 by laser welding in the present exemplary embodiment. The axial separation distance between the end of second noble metal chip 145 facing spark gap 150 and side surface 141 of ground electrode 140 can be selected as desired for a particular application, and can be in the range of 0.2 to 1.5 mm in exemplary embodiments. Second noble metal chip 145 is not too thin so as to be easily worn down. In exemplary embodiments, second noble metal chip 145 can comprise a platinum-based alloy including platinum in an amount of greater than 50 weight percent and at least one additive, which, in exemplary embodiments, can be selected from iridium, rhodium, nickel, tungsten, palladium, ruthenium, rhenium, aluminum, alumina, and yttrium. In exemplary embodiments, second noble metal chip 145 can comprise an iridium-based alloy including iridium in an amount of greater than 50 weight percent and at least one additive, which, in exemplary embodiments, can be selected from platinum, rhodium, nickel, tungsten, palladium, ruthenium, rhenium, aluminum, alumina, and yttrium. In exemplary embodiments, the platinum- or iridium-based alloy can have a melting point of greater than 1500 degrees Celsius.

Referring back to the illustration of the present exemplary embodiment of FIG. 1, an end 130*b* of center electrode 130 is, within center bore 121 of insulator 120, electrically connected to an end of a resistive element 160 through a glass seal 161 that comprises an electrically conductive material. In exemplary embodiments, glass seal 161 can be a fired-in seal (conductive or otherwise) that coaxially surrounds resistive element 160 such that it is located between the inner surface of insulator 120 and the outer surface of the resistive element. Resistive element feeds spark gap 150 with a high voltage ignition. The other end of resistive element 160 is electrically connected, through the glass sealing material 161, to an end 170*a* of a cylindrical terminal electrode 170. Terminal electrode 170 is secured within center bore 121 of insulator 120 such that another end 170*b* thereof, to which an ignition coil boot (not shown) is fixed, protrudes from end 120*b* of the insulator.

In exemplary embodiments, terminal electrode 170 can comprise a highly heat-resistant, corrosion-resistant metal material such as, for example, solid steel alloy, a steel-based alloy, Inconel, another nickel-based alloy, or other suitable metal or metal alloy. As shown in FIG. 1, insulator 120 is provided with an interior shoulder 127 that occurs at an inner diameter transition of axial bore 121 so that the insulator can receive and support resistive element 160 and terminal electrode 170.

Figure 5:
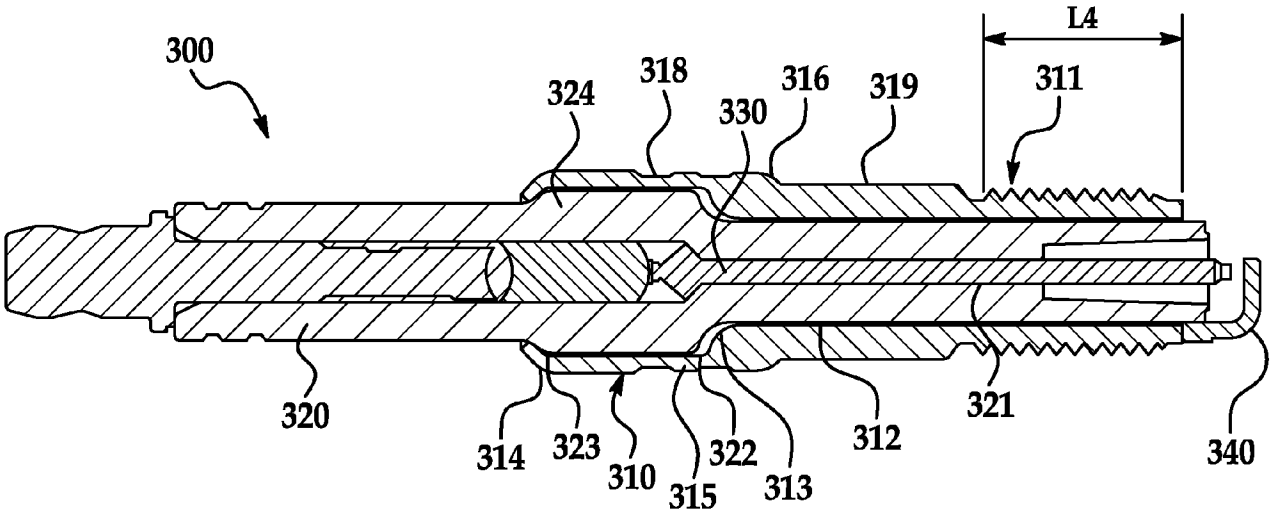
FIG. 5 is a cross-sectional view of another alternative exemplary embodiment of a spark plug in accordance with the present invention.

It should be noted that the shape, size, and particular construction of the metal shell may, of course, vary greatly from one design to another in accordance with exemplary embodiments of the present invention; hence, the specific dimensional attributes of metal shell 110 and 210, as shown in FIGS. 1 and 3, are provided only as an exemplary embodiment. For instance, FIG. 5 illustrates an alternative exemplary embodiment of a spark plug in accordance with the present invention. Spark plug 300 is shown in FIG. 5 including an essentially tube-shaped metal shell 310, an insulator 320, a cylindrical center electrode 330, and a ground electrode 340 attached to metal shell 310 at its combustion chamber side end. Metal shell 310 includes an axial bore 312 that extends throughout its length. Insulator 320 is an elongated component that is partially situated within axial bore 312 and generally includes an axial bore 321 extending therethrough in which center electrode 330 is retained, as well as exterior shoulders 322, 323 that are located at either end of an expanded flange portion 324 of the insulator.

In the present exemplary embodiment, metal shell 310 includes a threaded shank portion 311 for installing spark plug 300 into a threaded hole in the cylinder head of an engine, a substantially frusto-conical interior shoulder 313, and an essentially cylindrical attachment or mounting feature 315 extending between a pair of deformable rims 314, 316 on an exterior of the metal shell. Installation feature 315 can be shaped, for example, in the form of a double hexagon having a shrinking area 318 to permit an appropriate tool, such as a wrench, to engage metal shell 310 for installation or removal of spark plug 300 in the cylinder head.

In the present exemplary embodiment, metal shell is formed with a threaded portion 311 having a shortened axial shell thread reach L4. Threaded portion 311 is used for fitting spark plug 300 into the combustion chamber of the engine in the axial direction. A flat gasket seating area 319 extends in the axial transition area between threaded portion 311 and installation feature 315, and conical rim 316 serves as an external motor seat for ensuring tightness of the combustion chamber in this area. In exemplary embodiments, threaded portion 311 can have an axial shell thread reach L4 of 6 mm or more, and flat gasket seating area 319 can have can have an axial reach of 6 mm or more between threaded portion 311 and conical rim 316. However, as shown in FIG. 6, it is also contemplated that a metal casing 110' may include a flat surface 116' extending generally perpendicular to center electrode 130' for receiving and forming a seal with a gasket (not shown). While the above particular embodiments of the invention have been shown and described, it will be understood by those who practice the invention and those skilled in the art that various modifications, changes, and improvements may be made to the invention without departing from the spirit of the disclosed concept. For example, in the exemplary embodiments described above, first and second noble metal chips 135 and 145 are joined to the center and ground electrodes 130 and 140, respectively, by resistance welding. In other exemplary embodiments, however, other joining means may also be used, such as laser welding, plasma welding, and adhesive joining. Moreover, in exemplary embodiments, center electrode 130 and ground electrode 140 may not include noble metal chips 135 and 145 respectively. In addition, other detailed dimensional ranges and/or relationships may be suitably modified, or changed, in designing spark plug 100. Such modifications, changes, and improvements within the skill of the art are intended to be covered by the appended claims.

Thus, while the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims and their legal equivalence.

What is claimed is:

1. A spark plug comprising:

a metallic shell having a shell bore extending axially therethrough and a first open end proximate a spark gap;

an insulator being at least partially disposed within the shell bore, the insulator having an insulator bore extending axially therethrough and a first open end proximate the spark gap, the insulator having an intermediate portion adjoining an end portion, the end portion having an exterior surface that abuts an interior surface of the first open end of the metallic shell and the end portion has a nose portion axially extending beyond the first open end of the metallic shell by a first length, the end portion defining a counterbore that extends inwardly into the insulator from the first open end of the insulator; and a center electrode at least partially disposed within the insulator bore and having a first end forming part of the spark gap, the center electrode extending beyond the first open end of the metallic shell by at least the first length, wherein a portion of the center electrode is located within the counterbore and an air insulation gap extends from the portion of the center electrode received within the counterbore to an inner surface of the end portion defining the counterbore, wherein the insulator further comprises a projection extending axially within the counterbore, the projection being located within the counterbore and wherein the projection is located about a portion of the center electrode located within the counterbore and wherein the air insulation gap is located between the inner surface of the counterbore and an exterior surface of the projection.

2. The spark plug of claim 1, further comprising a ground electrode joined to and extending from the first open end of the metallic shell, the ground electrode having a tip portion that includes a side surface facing the first end of the center electrode to form the spark gap therebetween.

3. The spark plug of claim 1, wherein the first length is at least 0.5 mm.

4. The spark plug of claim 1, wherein the diameter of the counterbore is generally constant along a length of the counterbore.

5. The spark plug of claim 1, wherein the diameter of the counterbore varies along a length of the counterbore.

6. The spark plug of claim 1, wherein the inner surface of the counterbore has a plurality of ribs extending about an axis of the counterbore.

7. The spark plug of claim 1, wherein the inner surface of the counterbore has a plurality of steps along the length of the counterbore.

8. The spark plug of claim 1, wherein the metallic shell has a generally frusto-conical first interior shoulder facing into the shell bore, and wherein the insulator has a generally frusto-conical first exterior shoulder facing into the shell bore, the first exterior shoulder of the insulator being shaped complimentarily to the first interior shoulder of the metallic shell and situated axially to engage the first interior shoulder via a gas tight annular seal.

9. The spark plug of claim 8, wherein the annular seal is a metal ring gasket.

10. The spark plug of claim 1, wherein the intermediate portion and end portion of the insulator includes an exterior surface extending along a length of the intermediate portion and end portion, the exterior surface having a substantially constant diameter.

11. The spark plug of claim 10, wherein the metallic shell includes a threaded portion formed along an exterior surface thereof, the threaded portion being disposed about the intermediate portion and end portion of the insulator.

12. The spark plug of claim 11, wherein the threaded portion of the metallic shell has an outer diameter of 14 mm or less and an axial length of 12 mm or more.

13. A spark plug comprising:

a metallic shell;

an insulator being at least partially disposed within the metallic shell, the insulator having an end portion, which extends from an end portion of the metallic shell;

a center electrode at least partially disposed within the insulator; and wherein a portion of the center electrode is located within a counterbore defined by a wall portion of the end portion of the insulator such that only an air insulation gap extends from an inner surface of the wall portion of the insulator to an exterior surface of a portion of the center electrode disposed in the counterbore;

wherein an exterior surface of the wall portion abuts an inner surface of the end portion of the metallic shell into which the insulator is received; and wherein another portion of the center electrode received within the counterbore is surrounded by a portion of the insulator that is spaced from the inner surface of the wall portion of the insulator such that the air insulation gap is disposed therebetween.

14. The spark plug as in claim 13, wherein the insulator further comprises an intermediate portion adjacent to the end portion of the insulator, wherein an the intermediate portion and the end portion of the insulator have generally the same exterior dimensions.

* * * * *